US005870071A

United States Patent [19]

Kawahata

[11] Patent Number: 5,870,071

[45] Date of Patent: Feb. 9, 1999

[54] LCD GATE LINE DRIVE CIRCUIT

[75] Inventor: Ken Kawahata, Miyagi-ken, Japan

[73] Assignee: Frontec Incorporated, Miyagi-Ken, Japan

[21] Appl. No.: 708,588

[22] Filed: Sep. 5, 1996

[30] Foreign Application Priority Data

Sep. 7, 1995 [JP] Japan ..... 7-230562

[51] Int. Cl.[6] ..... G09G 3/36

[52] U.S. Cl. ..... 345/100

[58] Field of Search ..... 345/98–100, 204–206, 345/211–213; 377/75, 76

[56] References Cited

U.S. PATENT DOCUMENTS 5,194,853 3/1993 Asada ..... 345/100
5,448,259 9/1995 Hidaka ..... 345/99
5,701,136 12/1997 Huq et al. ..... 345/100

FOREIGN PATENT DOCUMENTS

06337655 A 12/1994 Japan .

*Primary Examiner*—Jeffery Brier
*Attorney, Agent, or Firm*—Brinks Hofer Gilson & Lione

[57] ABSTRACT

An LCD gate line drive circuit is constituted by plural stages of TFT-LCD drive circuits which are each composed of a shift register, a set/reset flip-flop and a buffer section and which are successively driven repeatedly. A set input terminal in each stage of drive circuit is connected to an output terminal of the preceding stage of drive circuit, while a reset input terminal in each stage of drive circuit is connected to an output terminal of the succeeding stage of drive circuit, and an operating bias current in the buffer section of the stage concerned is turned ON only during the period from the start of drive in the preceding stage until the start of drive in the succeeding stage.

5 Claims, 8 Drawing Sheets

LCD GATE LINE DRIVE CIRCUIT

BACKGROUND OF THE INVENTION

1. Field of the Invention

The present invention relates to an LCD drive circuit formed integrally with a liquid crystal display panel and more particularly to an LCD drive circuit suitable for use in a TFT-LCD (Thin Film Transistor-Liquid Crystal Display) circuit.

2. Description of the Prior Art

In the field of TFT-LCD, attempts have heretofore been made to incorporate a drive circuit in the body of an LCD.

That is because the drive circuit for driving an LCD is generally fabricated as an integrated circuit and is disposed around the LCD. In other words, the reason for making the aforesaid attempts is that a display panel or the like using an LCD assumes a picture frame-like shape and the actual display area of the LCD is narrowed.

According to a method for solving the above-mentioned problem, a shift register constituted by an n-channel FET (Field Effect Transistor) for example is formed as an LCD drive circuit on the glass substrate which constitutes the LCD.

According to a broad classification of such n-channel FET shift registers, the following shift registers are conceivable.

FIGS. 8A and 8B show configuration examples of n-channel shift registers. First, the shift register shown in FIG. 8A is constituted by a ratio circuit.

In the shift register shown in FIG. 8A, clock input terminals $\phi_1$ and $\phi_{-1}$ supply clock signals of opposite phases. Consequently, with $\phi_1$ at "H" (high level), the value of an input terminal D is read in, while when $\phi_{-1}$ is at "H," the state of the input terminal D which has been read in appears at an output terminal Q. In the same figure, Vd denotes a drain voltage (power source).

In the above ratio circuit, however, a steady-state through current flows through the circuit, so that the power consumption increases, which is an obstacle to the reduction in size of the circuit.

On the other hand, the shift register shown in FIG. 8B is constituted by a ratioless circuit. In the shift register shown therein, pulse type clock signals of different phases as shown in FIG. 8C are applied to clock input terminals $\phi_1$ to $\phi_4$. In this circuit, with $\phi_1$ at "H," C is charged; with $\phi_2$ at "H," the value of an input terminal D is read in; and with $\phi_4$ at "H," the state of the input terminal D which has been read in is reflected in an output terminal Q.

However, the above ratioless circuit is disadvantageous in that a pulse is mixed into the output signal in order to maintain the operation of the circuit.

For eliminating such a drawback it is required to connect a static inverter as a buffer to the output terminal Q, but an increase of power consumption results.

As a display device which replaces a CRT (Cathode Ray Tube), the TFT-LCD is in many cases applied to a device which displays an image on the basis of a so-called television signal (a composite signal having both a luminance signal and a synchronizing signal).

Heretofore, in the television signal a vertical retrace interval proportional to a vertical synchronizing timing and a horizontal retrace interval proportional to a horizontal synchronizing timing have been present in association with both the scanning characteristic and decay characteristic of the CRT.

In Japanese Published Unexamined Patent Application No. Hei 6-337655 (1994) is disclosed a technique such that in both retrace periods mentioned above the operation of all buffers each inserted in the output terminal of a shift register is stopped to diminish the power consumption of the LCD.

However, even with the technique disclosed in the above unexamined publication, the reduction in power consumption of the LCD drive circuit can be expected only 10% to 20%.

SUMMARY OF THE INVENTION

With such circumstances as background the present invention has been accomplished and it is an object of the invention to provide an LCD drive circuit of a low power consumption.

According to the present invention, in order to solve the above-mentioned problems, there is provided an LCD drive circuit comprising plural stages of drive circuits, the drive circuits each including: a shift register for converting an inputted drive signal into an output signal in synchronism with an inputted synchronizing signal and outputting the output signal; a buffer section which is driven by an operating bias current and which outputs a drive signal for driving an LCD in accordance with the output signal provided from the shift register; and a flip-flop having a set input portion for providing the operating bias current to the buffer section and a reset input portion for cutting off the operating bias current to be provided to the buffer section, wherein the set input portion of the flip-flop in each of the plural stages of drive circuits which are scanned successively with the above synchronizing signal is connected to an output terminal of the preceding stage of drive circuit, the output terminal being connected to the LCD, and the reset input portion of the flip-flop in each of the plural stages of drive circuits is connected to an output terminal of the succeeding stage of drive circuit, the output terminal being connected to the LCD.

A modification may be made so that an externally generated drive signal is inputted to the set input portion of the flip-flop in the first stage of drive circuit out of the plural stages of drive circuits.

In the present invention, moreover, there may be adopted a construction wherein to the reset input portion of the flip-flop in the final stage of drive circuit is inputted a stop signal to cut off the operating bias current in the final stage.

Further, as the shift register there may be used a ratioless shift register circuit.

Further, the buffer section used in the present invention may be constituted by a plurality of field effect transistors and a bootstrap circuit formed by those plural field effect transistors.

The LCD drive circuit according to the present invention is constituted by plural stages of drive circuits each comprising a shift register, a set/reset flip-flop and a buffer section, the plural stages of drive circuits being successively driven repeatedly. A set input section in each stage is connected to an output terminal of the preceding stage of drive circuit, while a reset input section in each stage is connected to an output terminal of the succeeding stage of drive circuit, and the operating bias current in the buffer section being driven is turned ON only during the period after the start of drive in the preceding stage until the start of drive in the succeeding stage.

BRIEF DESCRIPTION OF THE DRAWINGS

FIGS. 1A and 1B are principle diagrams showing operation principles of a buffer section which is a characteristic section in an LCD drive circuit of the present invention, in which FIG. 1A is a principle diagram showing the configuration of the buffer section and FIG. 1B is a diagram showing in what manner signals vary in various components of the circuit illustrated in FIG. 1A;

FIGS. 8A, 8B and 8C are diagrams showing configuration examples of dynamic shift registers used in conventional LCD drive circuits, in which FIG. 8A is a diagram showing an example constituted by a ratio circuit, FIG. 8B is a diagram showing an example constituted by a ratioless circuit, and FIG. 8C is a diagram showing clock signals which are supplied respectively to clock input terminals $\phi_1$ to $\phi_4$ in the configuration of FIG. 8B.

DESCRIPTION OF THE PREFERRED EMBODIMENTS

Embodiments of the present invention will be described hereinunder. FIG. 1 is a diagram explaining operation principles of a buffer section 10 as a characteristic portion of an LCD drive circuit according to the invention, in which FIG. 1A is a configuration diagram and FIG. 1B is a timing chart showing in what state signals vary in various components of the circuit illustrated in FIG. 1A.

Figure 1A:
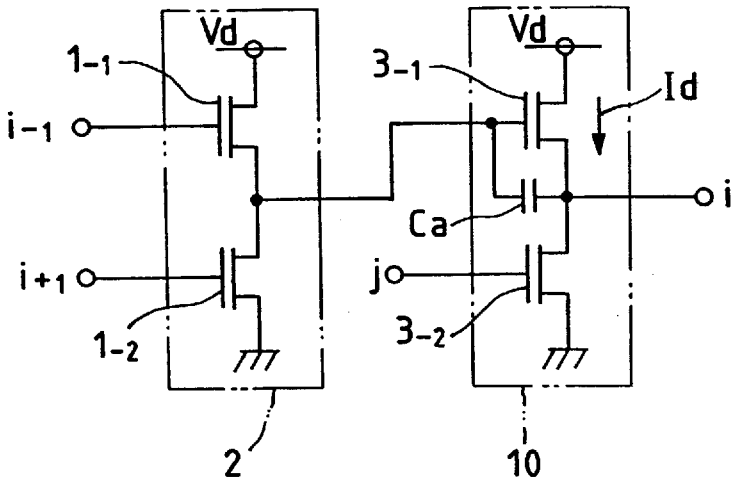
Figure 1B:
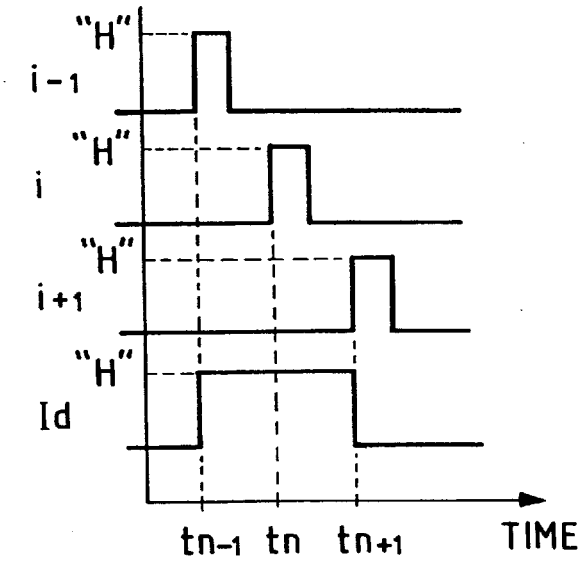

As shown in FIG. 1A, the buffer section 10 is composed of FET3$_{-1}$ and FET3$_{-2}$ and is connected to a flip-flop 2 comprising FET1$_{-1}$and FET1$_{-2}$.

Generally, each picture element of a TFT-LCD has an FET (hereinafter referred to as "TFT") and is disposed at each intersecting point of a matrix formed by both plural data lines and plural gate lines. The gate lines correspond respectively to the scanning lines which constitute the screen of television. At the same time point, therefore, it is impossible that plural stages of gate lines will become "H" level simultaneously.

In the present invention, using the buffer section 10 shown in FIG. 1A, the operation thereof is started with a gate signal in the preceding stage and is stopped with a gate signal in the succeeding stage.

Concrete operations are as shown in FIG. 1B. For example, in the n stage at time $t_{n-1}$, a gate signal $i_{-1}$ in $n_{-1}$ stage as the preceding stage is inputted to the buffer section 10. At this point the FET1$_{-1}$ turns ON, so that a capacitor (bootstrap capacity) Ca is charged with a drain voltage Vd. Further, the FET3$_{-1}$ turns ON and a drain current Id (operating bias current) begins to flow.

While the drain current Id flows, the signal at an input terminal j is inverted and the inverted signal is applied to an output terminal i.

At time $t_{n+1}$, a gate signal $i_{+1}$ in $n_{+1}$ stage as the succeeding stage is inputted, whereby the FET1$_{-2}$ is turned ON and the capacitance Ca is discharged. As a result, the FET3$_{-1}$ turns OFF and the drain current Id stops.

So configurating the buffer section 10 results in a decrease in power consumption of the whole. For example, if k stages of gate lines are used, the power consumption becomes 2/k times as much and thus, the larger the number of stages, the more effective.

Figure 2:
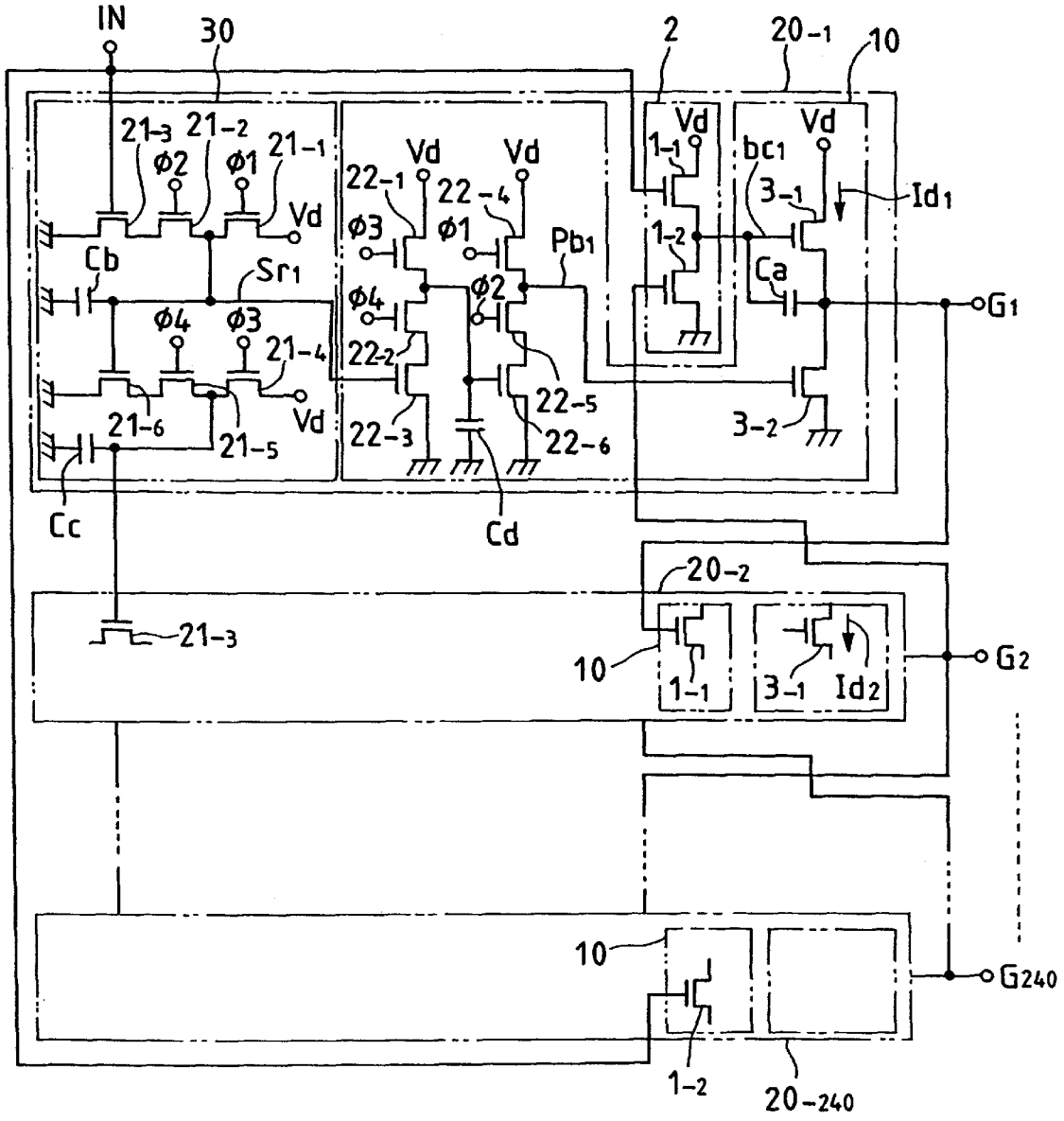
FIG. 2 is a connection diagram showing the configuration of an LCD drive circuit according to a first embodiment of the present invention.

FIG. 2 is a connection diagram showing the configuration of an LCD drive circuit according to a first embodiment of the present invention. In this embodiment, gate lines are composed of 240 stages and hence there are used 240 sets of drive circuits of the same structure.

Therefore, the configuration of only a drive circuit 20$_{-1}$ will be described below, and as to drive circuits 20$_{-2}$ to 20$_{-240}$, explanations thereof will be omitted.

The LCD drive circuit of this embodiment is formed through an amorphous silicon process integrally on a glass plate which constitutes a liquid crystal display panel. But the description of a mechanical construction thereof will be omitted.

In FIG. 2, FETs 21$_{-1}$ to 21$_{-6}$ and capacitors Cb and Cc constitute a ratioless shift register 30. In this configuration, the capacitor Cb is charged when $\phi_1$ is at "H," and the level of an input terminal IN is read in when $\phi_2$ is at "H." Further, with $\phi_3$ at "H," the capacitor Cc is charged, and with $\phi_4$ at "H," the state of the read-in level of the input terminal IN is reflected in the terminal level of the capacitor Cc.

FET22$_{-1}$ to 22$_{-6}$ and capacitor Cd operate as a prebuffer for the buffer section 10.

To the gate terminal of the FET21$_{-3}$ is inputted $Sr_1$ which represents the terminal level of the capacitor Cb. Accordingly, when the level of $\phi_3$ is "H," the capacitor Cd is charged, and when the level of $\phi_4$ is "H," the terminal level of the capacitor Cb is reflected in the terminal level of the capacitor Cd. Further, when the level of $\phi_2$ reaches "H," the terminal level of the capacitor Cd is outputted as $Pb_1$.

Figure 3:
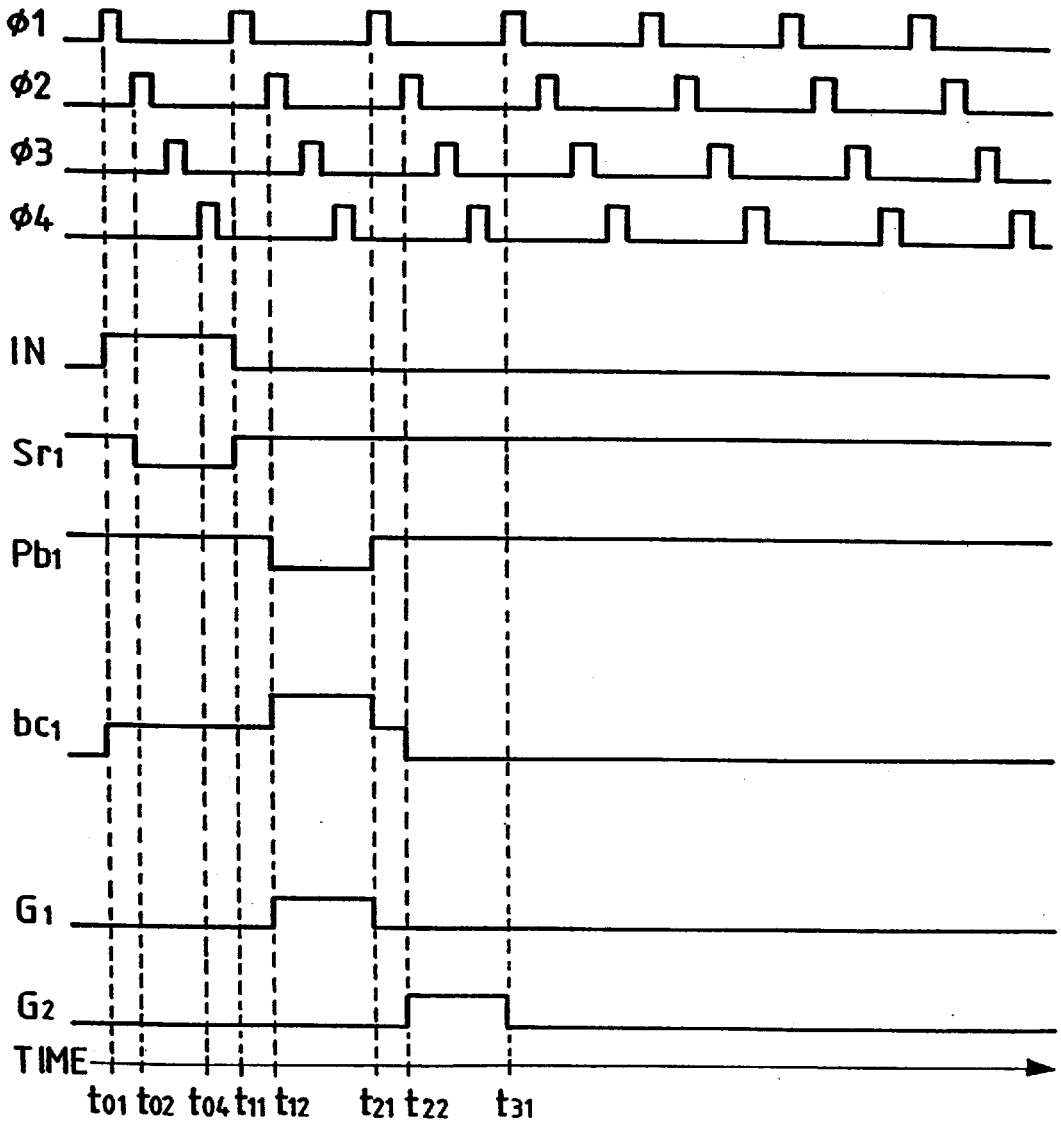
FIG. 3 is a timing chart showing in what state signals are in various components of the LCD drive circuit of the first embodiment.

FIG. 3 is a timing chart showing the state of the clock signals $\phi_1$ to $\phi_4$, that of signals of the input terminal IN, that of signals in various portions of the TFT-LCD drive circuit 20$_{-1}$ and that of signals at an output terminal $G_2$ Of the TFT-LCD drive circuit 20$_{-2}$. The operation of this embodiment will be described below with reference to FIGS. 2 and 3.

When the level of the input terminal IN goes "H" (time $t_{01}$), the capacitor Ca is charged because the FET1$_{-1}$ in the drive circuit 20$_{-1}$ turns ON, with the result that the FET3$_{-1}$ turns ON and a drain current $Id_1$ flows (that is, the level of $bc_1$ goes high and the buffer section 10 starts operating).

When $\phi_2$ becomes "H" (time $t_{02}$) with the input terminal IN at "H," $Sr_1$ goes "L (low level)." Thereafter, when $\phi$4 becomes "H" (time $t_{04}$), the terminal level of the capacitor Cc goes "H" reflecting the state of the input terminal IN, which signal is fed to the gate of the FET21$_{-3}$ in the drive circuit 20$_{-2}$.

The $Sr_1$ holds "L" until $\phi_1$ next goes "H" (time $t_{11}$) after making a round of clock pulses, whereupon the FET21$_{-1}$ turns ON and $Sr_1$ goes "H."

Thereafter, when $\phi_2$ goes "H" (time $t_{12}$), the state of $Sr_1$ is reflected in $Pb_1$, which goes "L." The $Pb_1$ holds "L" until $\phi_1$ next goes "H" (time $t_{21}$ ), whereupon the FET22$_{-4}$ turns ON and $Pb_1$ goes "H."

When $Pb_1$ goes "L" while the level of $bc_1$ is high (during the period from time $t_{01}$ to time $t_{22}$), an output terminal $G_1$ of the drive circuit $\mathbf{20}_{-1}$ goes "H." That is, in this embodiment, the output terminal $G_1$ goes "H" when $\phi_2$ goes "H" (time $t_{12}$) twice after the input terminal IN has become "H."

With the output terminal $G_1$ at "H," the FET$\mathbf{1}_{-1}$ in the drive circuit $\mathbf{20}_{-2}$ turns ON, resulting in that a drain current $Id_2$ flows in the FET$\mathbf{3}_{-1}$ (that is, the level of $bc_2$ (not shown) goes high and the buffer section 10 starts operating).

Subsequently, the drive circuit $\mathbf{20}_{-2}$ goes through the same operations as the foregoing operations of the circuit $\mathbf{20}_{-1}$, and when $\phi_2$ goes "H" (time $t_{22}$) three times after the input terminal IN has become "H," the output terminal $G_2$ goes "H."

With the output terminal $G_2$ at "H," the FET$\mathbf{1}_{-2}$ in the drive circuit $\mathbf{20}_{-1}$ turns ON, so that the level of $bc_1$ goes low (that is, the buffer section 10 stops operation).

Until $\phi_1$ next goes "H" (time $t_{31}$) after making another round of clock pulses the drive circuit $\mathbf{20}_{-2}$ maintains the output terminal $G_2$ at "H," whereupon the FET$\mathbf{22}_{-4}$ and $\mathbf{3}_{-2}$ turn ON and $G_2$ goes "L."

The same operations as above are repeated successively in the drive circuits $\mathbf{20}_{-3}$, $\mathbf{20}_{-4}$, . . . , whereby the terminal level ("H") of the input terminal IN is transferred to the drive circuit $\mathbf{20}_{-240}$.

The gate of the FET$\mathbf{1}_{-2}$ in the drive circuit $\mathbf{20}_{-240}$ is connected to the input terminal IN. Therefore, when the level of the input terminal IN next goes "H," the FET$\mathbf{1}_{-2}$ in the drive circuit $\mathbf{20}_{-240}$ turns ON and the level of $bc_{240}$ (not shown) goes low, so that the buffer section 10 stops operation.

Thus, out of 240 stages of gate lines, only two stages are brought into an operating state, while as to the other stages, the bias current (drain current) of the buffers is cut off to decrease the power consumption in all the circuits, which was found to be about 100 mW in this embodiment.

In the embodiment illustrated in FIG. 2, even if the FET$\mathbf{22}_{-1}$ to $\mathbf{22}_{-6}$ and the capacitor Cd in the portion acting as a prebuffer for the buffer section 10 are omitted and the output $Sr_1$ of the shift register 30 is inputted directly to the gate terminal of the FET$\mathbf{3}_{-2}$ in the buffer section 10, there will be obtained the same function as above.

Figure 4:
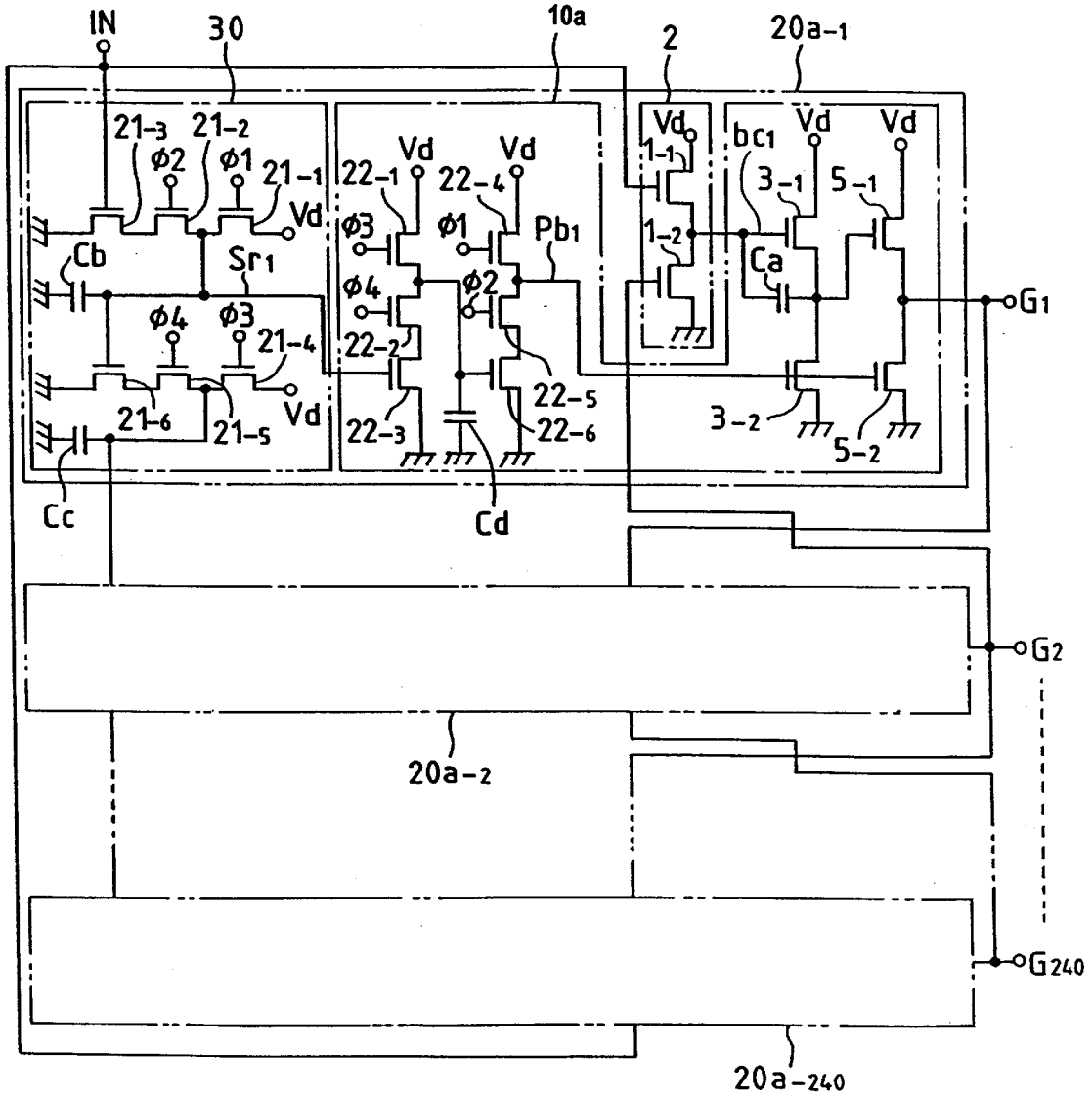
FIG. 4 is a connection diagram showing the configuration of an LCD drive circuit according to a second embodiment of the present invention.

FIG. 4 is a diagram showing the configuration of an LCD drive circuit according to a second embodiment of the present invention. In the same figure, drive circuits $\mathbf{20}a_{-1}$, $\mathbf{20}a_{-2}$, . . . $\mathbf{20}a_{-240}$ each employ a buffer section 10*a*.

The buffer section 10*a* is provided with a push-pull type inverter comprising FET$\mathbf{5}_{-1}$ and FET$\mathbf{5}_{-2}$ behind the FET$\mathbf{3}_{-1}$ and $\mathbf{3}_{-2}$ in the buffer section 10 (see FIG. 1).

Since the operation of this embodiment is substantially the same as that of the first embodiment described above, the detailed explanation thereof is here omitted, but according to the construction of this second embodiment the swing of output (the width of output level) can be taken large.

Besides, since transistors (FETs) smaller in size can be used in the portions requiring bias current, it becomes possible to further reduce the power consumption, which was found to be about 10 mW in this embodiment.

Figure 5:
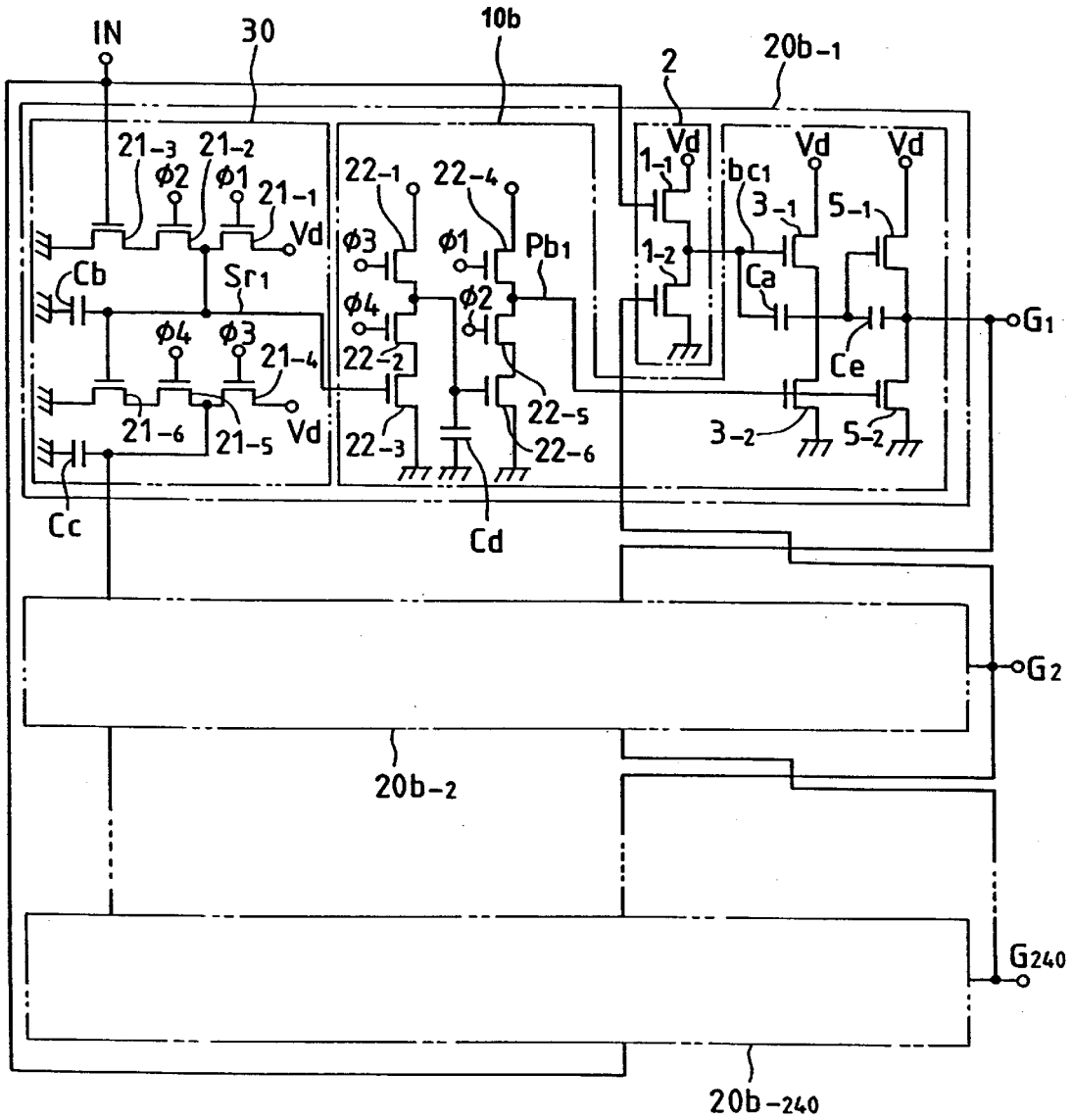
FIG. 5 is a connection diagram showing the configuration of an LCD drive circuit according to a third embodiment of the present invention.

FIG. 5 is a diagram showing the configuration of an LCD drive circuit according to a third embodiment of the present invention. Drive circuits $\mathbf{20}b_{-1}$, $\mathbf{20}b_{-2}$, . . . $\mathbf{20}b_{-240}$ shown in the same figure each employ a buffer section 10*b*.

In the buffer section 10*b*, a capacitor Ce is inserted between the gate and the source of the FET$\mathbf{5}_{-1}$ in the buffer section 10*a* (see FIG. 4), and these components form a bootstrap circuit.

The operation of this third embodiment is substantially the same as that of the second embodiment described above, so the explanation thereof is here omitted.

In each of the embodiments set forth above the drain current in the final stage (the 240th stage) is stopped with a signal applied to the input terminal IN. In the present invention, however, an END terminal for stopping the drain current may be provided independently in the FET$\mathbf{1}_{-2}$ of the final stage, as shown in FIG. 6 for example.

Figure 6:
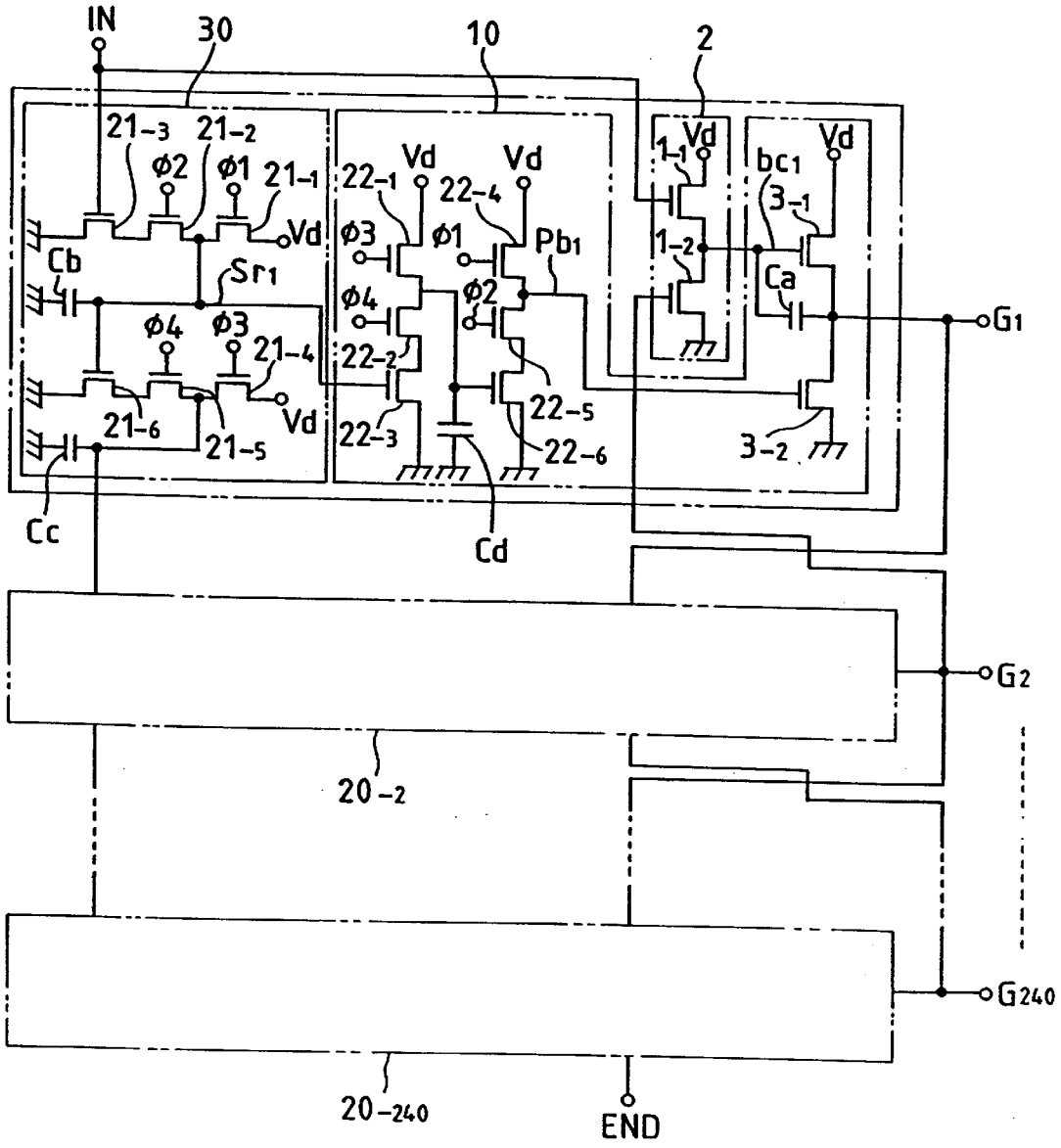
FIG. 6 is a diagram showing the configuration wherein an END terminal for stopping a drain current is provided at the final stage of gate line as a constituent of an LCD drive circuit embodying the invention.
Figure 7:
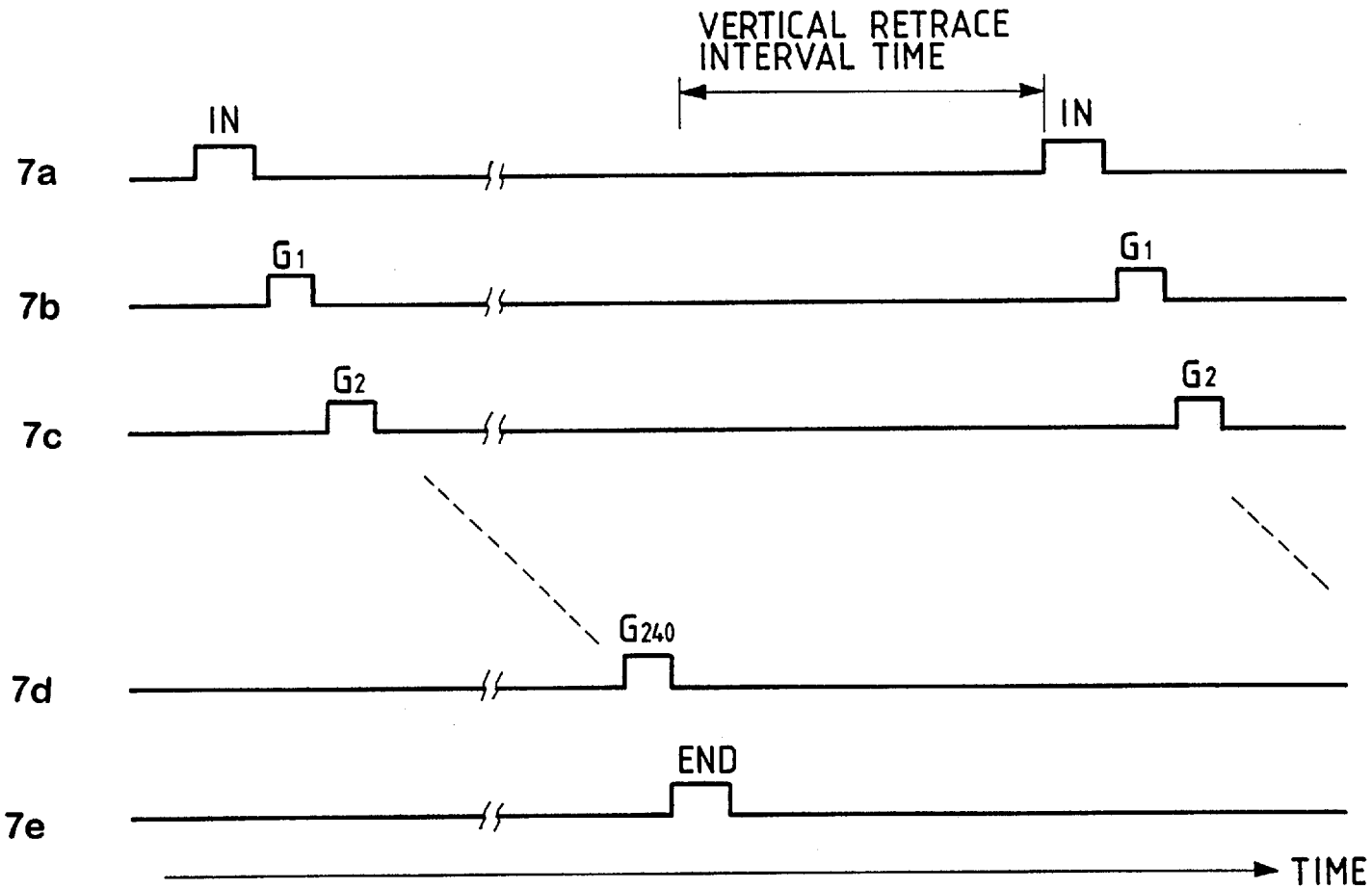
FIG. 7 is a timing chart showing in what state signals are in various components of the configuration illustrated in FIG. 6.
Figure 8A:
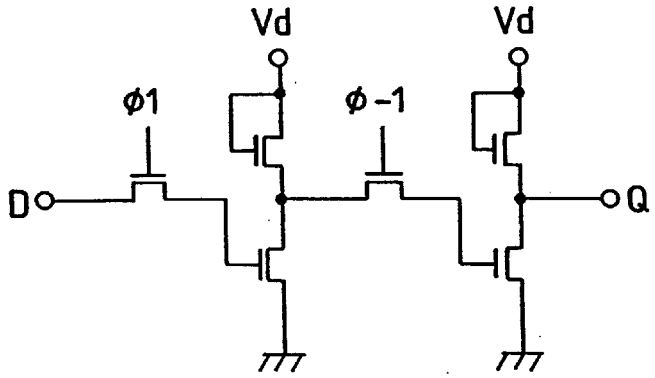
FIG. 8A PRIOR ART
Figure 8B:
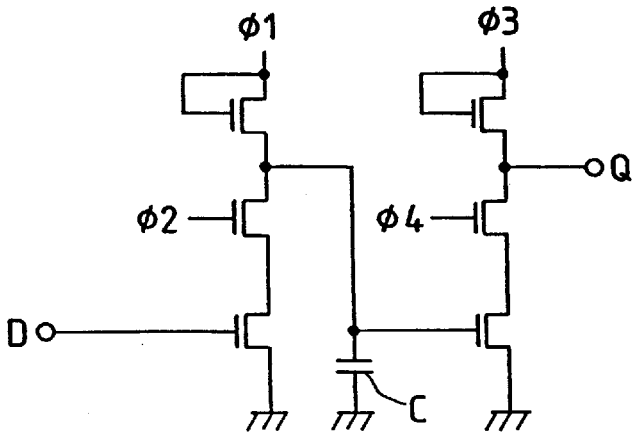
FIG. 8B PRIOR ART
Figure 8C:
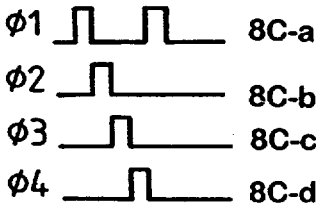
FIG. 8C PRIOR ART

In the configuration shown in FIG. 6, an "H" signal serving as a stop signal is fed to the END terminal after termination of the output period of the output terminal $G_{240}$, whereby during the vertical retrace interval all the drain current can be stopped as shown in FIG. 7.

For example, when the configuration provided with the END terminal as in FIG. 6 was applied to the configuration of the first embodiment described above, the power consumption was further decreased about 10%.

In each of the embodiments illustrated in FIGS. 4, 5 and 6, like the embodiment illustrated in FIG. 2, even if the FET$\mathbf{22}_{-1}$ to $\mathbf{22}_{-6}$ and the capacitor Cd in the portion acting as a prebuffer for the buffer section 10 are omitted and the output $Sr_1$ of the shift register 30 is inputted directly to the gate terminal of the FET$\mathbf{3}_{-2}$ in the buffer section 10, there can be attained the same function as mentioned above.

The number of stages of gate lines and that of phase of each clock signal shown in the above embodiments constitute no limitation. The present invention is also applicable to other numbers.

As set forth hereinabove, the LCD drive circuit of the present invention is constituted by plural stages of drive circuits driven successively in a repeated manner and each comprising a shift register, a set/reset flip-flop and a buffer section. The set input terminal in each stage is connected to the output terminal of the preceding stage of drive circuit, while the reset input terminal in each stage is connected to the output terminal of the succeeding stage of drive circuit, and the operating bias current in the buffer section of the stage concerned is turned ON only during the period from the start of drive of the preceding stage until the start of drive of the succeeding stage, whereby there can be realized an LCD drive circuit of a small power consumption.

What is claimed is:

1. An LCD drive circuit comprising plural stages of drive circuits, said drive circuits each including:

a shift register for converting an inputted drive signal into an output signal in synchronism with an inputted synchronizing signal and outputting the output signal;

a buffer section which is driven by an operating bias current and which outputs a drive signal for driving an LCD in accordance with the output signal provided from the shift register; and a flip-flop including a set input section for controlling said operating bias current so as to cause said buffer section to be driven by said operating bias current and a reset input section for shutting off said operating bias current for said buffer section;

wherein the set input portion of said flip-flop in each of the plural stages of drive circuits which are scanned successively with said synchronizing signal is connected to an output terminal of the preceding stage of drive circuit, said output terminal being connected to the LCD, and the reset input portion of said flip-flop in each of the plural stages of drive circuits is connected to an output terminal of the succeeding stage of drive circuit, said output terminal being connected to the LCD.

2. An LCD gate line drive circuit according to claim 1, wherein an externally generated drive signal is inputted to the set input portion of said flip-flop in the first stage of drive circuit out of the plural stages of drive circuits.

3. An LCD gate line drive circuit according to claim 1, wherein a stop signal to cut off the operating bias current in the final stage of drive circuit is inputted to the reset input portion of said flip-flop in the final stage of drive circuit.

4. An LCD gate line drive circuit according to claim 1, wherein a ratioless shift register circuit is used as said shift register.

5. An LCD gate line drive circuit according to claim 1, wherein said buffer section comprises a plurality of field effect transistor and a bootstrap circuit formed by said plural field effect transistors.

* * * * *